US011835903B2

(12) United States Patent
Hayamizu et al.

(10) Patent No.: US 11,835,903 B2
(45) Date of Patent: Dec. 5, 2023

(54) ELECTRONIC APPARATUS THAT PREDICTS REMAINING SERVICE LIFE OF LIMITED-LIFE COMPONENT, ON BASIS OF FREQUENCY ANALYSIS OF SOUND DATA

(71) Applicant: KYOCERA Document Solutions Inc., Osaka (JP)

(72) Inventors: Hitoshi Hayamizu, Osaka (JP); Daijiro Ueno, Osaka (JP); Tetsuya Ueno, Osaka (JP); Hisaji Kawai, Osaka (JP); Haruki Sayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/954,714

(22) Filed: Sep. 28, 2022

(65) Prior Publication Data

US 2023/0098844 A1 Mar. 30, 2023

(30) Foreign Application Priority Data

Sep. 30, 2021 (JP) ..... 2021-161418

(51) Int. Cl.
*G03G 15/00* (2006.01)

(52) U.S. Cl.
CPC ..... *G03G 15/55* (2013.01); *G03G 15/757* (2013.01); *G03G 2215/00637* (2013.01)

(58) Field of Classification Search
CPC ..... G03G 15/55; G03G 15/757; G03G 2215/00637
USPC ..... 399/12
See application file for complete search history.

(56) References Cited

U.S. PATENT DOCUMENTS

2009/0097870 A1* 4/2009 Misumi ..... G03G 15/5079 399/36
2016/0147187 A1* 5/2016 Muramoto ..... G03G 15/5062 399/9
2019/0265626 A1* 8/2019 Nakamoto ..... G03G 15/5016
2021/0311425 A1* 10/2021 Hara ..... G03G 15/5008

FOREIGN PATENT DOCUMENTS

EP 3422109 B1 * 3/2020 ..... G03G 15/2028
JP 2004226482 A 8/2004
JP 2014199397 A 10/2014
JP 2016022619 A 2/2016

* cited by examiner

*Primary Examiner* — Quana Grainger
(74) *Attorney, Agent, or Firm* — IP BUSINESS SOLUTIONS, LLC

(57) ABSTRACT

An electronic apparatus includes a drive unit having a drive roller, a driving motor, and a limited-life component, a sound collecting device that collects sound from the limited-life component, and outputs sound data, a storage device storing in advance a sound pressure level corresponding to a specific frequency of the limited-life component, with respect to each of different lengths of the remaining service life, and a controller that analyzes frequency of the sound data at predetermined time points; acquires the sound pressure level corresponding to the specific frequency of the limited-life component, on a basis of a result of the frequency analysis; compares the acquired sound pressure level with the sound pressure level of each of the lengths of the remaining service life; predicts the remaining service life of the limited-life component, on a basis of comparison result; and displays the predicted remaining service life on a display device.

3 Claims, 7 Drawing Sheets

ELECTRONIC APPARATUS THAT PREDICTS REMAINING SERVICE LIFE OF LIMITED-LIFE COMPONENT, ON BASIS OF FREQUENCY ANALYSIS OF SOUND DATA

INCORPORATION BY REFERENCE

This application claims priority to Japanese Patent Application No. 2021-161418 filed on Sep. 30, 2021, the entire contents of which are incorporated by reference herein.

BACKGROUND

The present disclosure relates to an electronic apparatus, and in particular to a technique to predict a remaining service life of a limited-life component.

Techniques to predict degradation status of components of an electronic apparatus are generally known. For example, a first known technique includes detecting driving sound of a motor and friction noise of a blade, thereby identifying the component emitting abnormal noise, on the basis of the detected driving sound and a frequency corresponding to the peak of the friction noise, and estimating a service life of the identified component, on the basis of the working time of the component and the time before a noise limit is reached, which are estimated from the peak value.

A second known technique includes detecting the noise generated from a driving motor that drives a photoconductor drum of an image forming device, and a drive unit including a reduction gear train, and determining the degradation status of the drive unit, on the basis of the difference between the detected noise and reference noise.

Further, a third known technique includes predicting the remaining service life of components, such as a scanner motor or a cooling fan emitting abnormal noise, on the basis of a magnitude of operating sound that has been decided as abnormal noise.

SUMMARY

The disclosure proposes further improvement of the foregoing techniques.

In an aspect, the disclosure provides an electronic apparatus including a drive unit, a control device, a sound collecting device, a storage device, and a display device. The drive unit includes a drive roller configured to rotate about an axial line, a driving motor connected to the drive roller, and a limited-life component that degrades with rotation of the drive roller. The control device includes a processor, and acts as a controller that drives the driving motor so as to rotate the drive roller, when the processor executes a control program. The sound collecting device collects sound of the limited-life component generated while the drive roller is rotating, and outputs sound data. The storage device stores in advance a sound pressure level corresponding to a specific frequency of the limited-life component, with respect to each of different lengths of the remaining service life. The controller performs frequency analysis of the sound data outputted from the sound collecting device at each of predetermined time points, acquires the sound pressure level corresponding to the specific frequency of the limited-life component, on a basis of a result of the frequency analysis, compares between the acquired sound pressure level and the sound pressure level corresponding to each of the different lengths of the remaining service life, predicts the remaining service life of the limited-life component, on a basis of a comparison result, and causes the display device to display a screen showing the predicted remaining service life.

DETAILED DESCRIPTION

Figure 1:
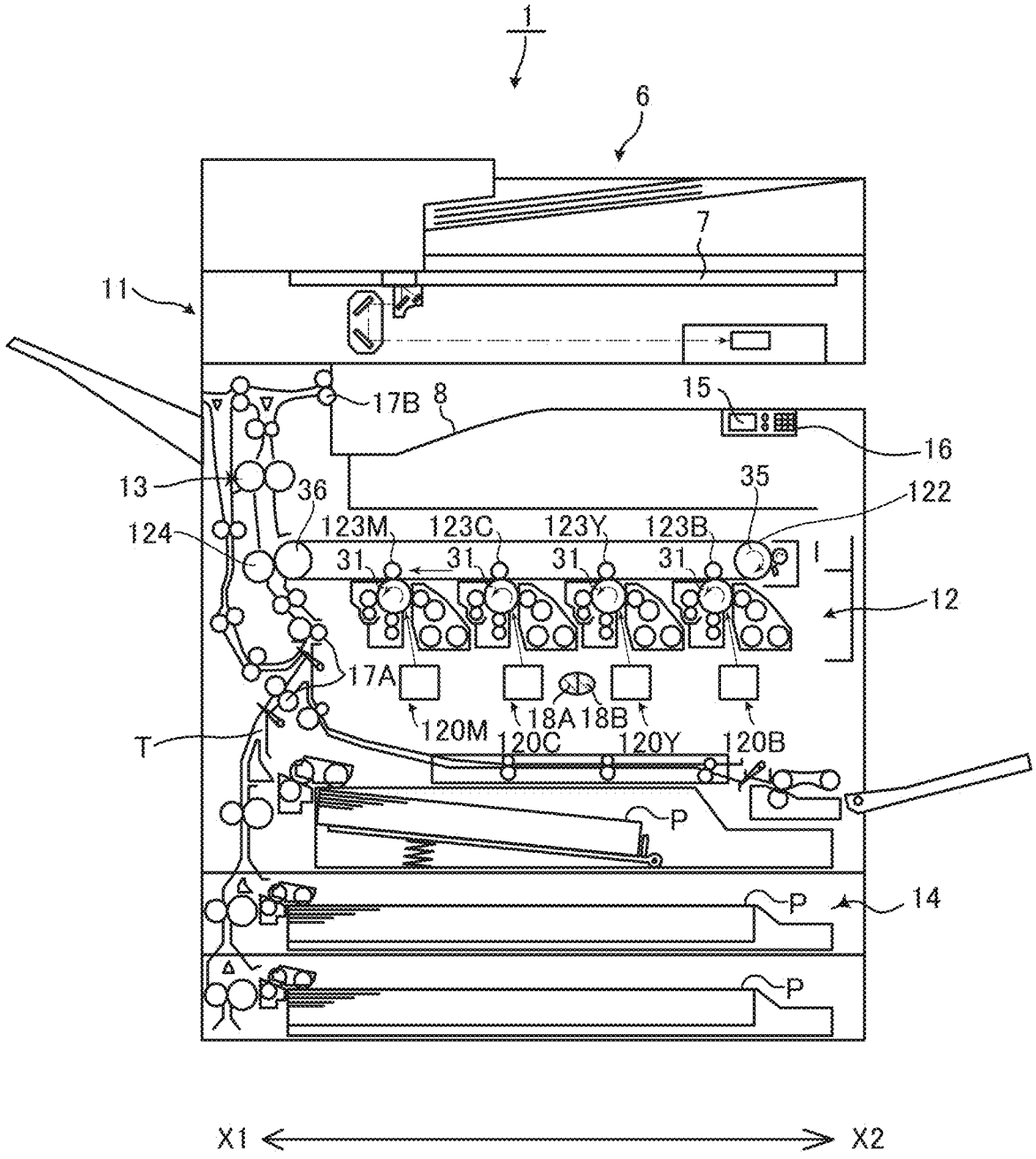
FIG. 1 is a front cross-sectional view showing a structure of an image forming apparatus according to an embodiment of the disclosure.
Figure 2:
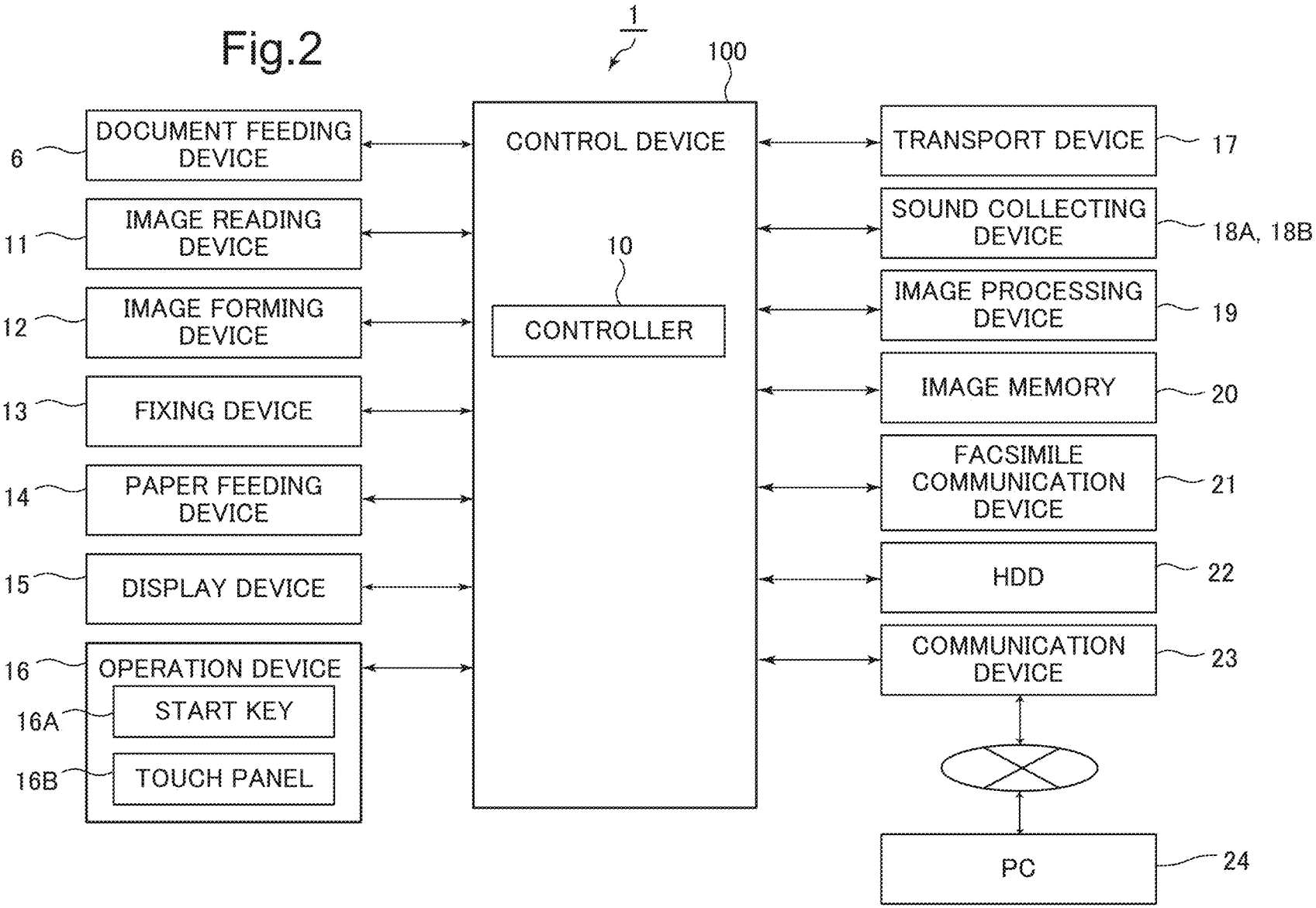
FIG. 2 is a block diagram showing a configuration of the image forming apparatus.

Hereafter, an image forming apparatus, exemplifying an electronic apparatus according to an embodiment of the disclosure, will be described with reference to the drawings. FIG. 1 is a front cross-sectional view showing a structure of the image forming apparatus according to the embodiment of the disclosure. FIG. 2 is a block diagram showing a configuration of the image forming apparatus.

[Configuration of Apparatus]

Referring to FIG. 1, the image forming apparatus 1 is a multifunction peripheral having a plurality of functions, such as copying, transmitting, printing, and facsimile transmission. In a casing of the image forming apparatus 1, a plurality of components for realizing various functions of the image forming apparatus 1 are provided. For example, an image reading device 11, an image forming device 12, a fixing device 13, a paper feeding device 14, and so forth are provided inside the casing.

Referring to FIG. 2, the image forming apparatus 1 includes a control device 100. The control device 100 includes a processor, a random-access memory (RAM), a read-only memory (ROM), and so forth. The processor is, for example, a central processing unit (CPU), a micro processing unit (MPU), or an application specific integrated circuit (ASIC).

The control device 100 acts as a controller 10, when the processor operates executes a control program stored in the ROM or a HDD 22. The controller 10 serves to control the overall operation of the image forming apparatus 1. To be more detailed, the controller 10 controls the operation of each of the components of the image forming apparatus 1, and communication with a personal computer (PC) 24 connected via a network. Here, the controller 10 may be constituted of a logic circuit, instead of being realized by the operation according to the control program.

The control device 100 is electrically connected to a document feeding device 6, the image reading device 11, the image forming device 12, the fixing device 13, the paper feeding device 14, a display device 15, an operation device 16, a transport device 17, sound collecting devices 18A and 18B, an image processing device 19, an image memory 20, a facsimile communication device 21, the HDD 22, and a communication device 23.

The image reading device 11 is configured as an automatic document feeder (ADF) including a document feeding device 6 that delivers a source document placed on a document table, and a scanner that optically reads the source document, delivered from the document feeding device 6 or placed on a platen glass 7. The image reading device 11 reads the image of the source document, by emitting light from a light emitting device to the source document and receiving the reflected light with a charge-coupled device (CCD) sensor, and generates image data representing the source image.

The image forming device 12 includes an image forming unit 120B for black, an image forming unit 120Y for yellow, an image forming unit 120C for cyan, and an image forming unit 120M for magenta, which are located at different positions. The image forming units 120B, 120Y, 120C, and 120M have the same structure as each other, only except for the color of the toner. Hereinafter, the image forming units 120B, 120Y, 120C, and 120M may be collectively referred to as "image forming unit 120", where appropriate.

Figure 3:
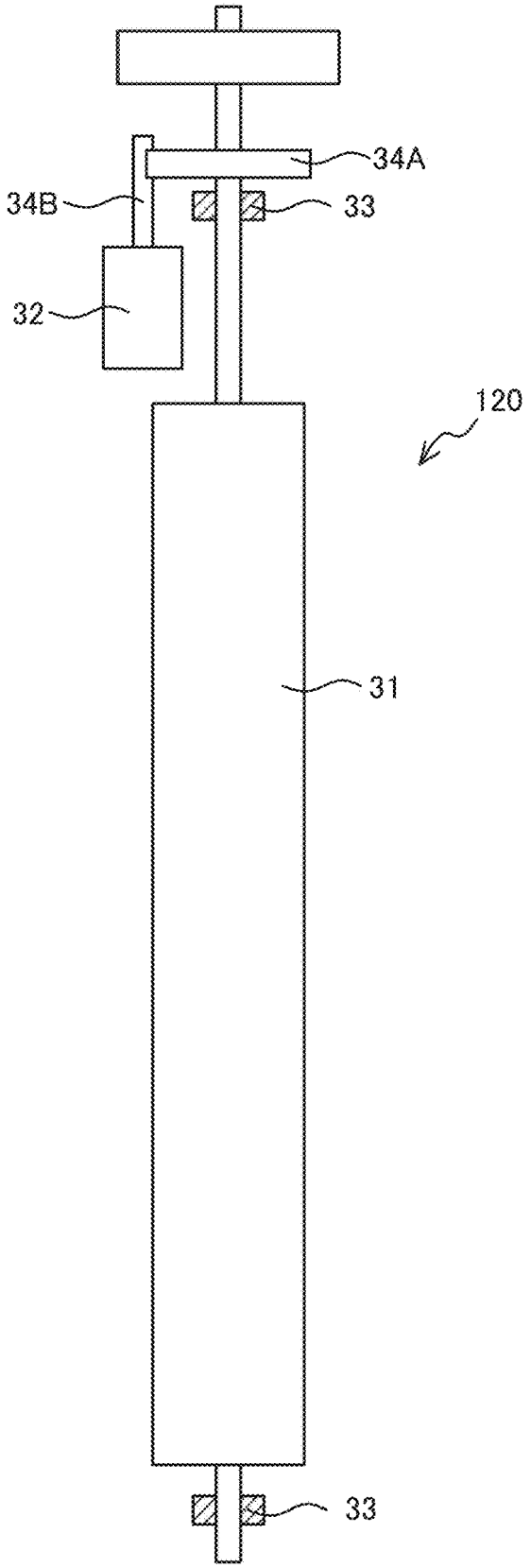
FIG. 3 is a schematic drawing showing a configuration of a part of an image forming unit.

FIG. 3 illustrates an example of the configuration of a part of the image forming unit 120. Referring to FIG. 3, the image forming unit 120 includes a photoconductor drum 31, a driving motor 32, a bearing 33, a first gear 34A, and a second gear 34B. The photoconductor drum 31 is a drive roller configured to rotate about the axial line thereof. The driving motor 32 is connected to the photoconductor drum 31, via the first gear 34A and the second gear 34B. The controller 10 drives the driving motor 32, so as to cause the photoconductor drum 31 to rotate counterclockwise.

The bearing 33 is provided at each of end portions of the photoconductor drum 31 in the axial direction. The bearing 33 rotatably supports the photoconductor drum 31. The first gear 34A and the second gear 34B transmit the driving force of the driving motor 32 to the photoconductor drum 31. The bearing 33, the first gear 34A, and the second gear 34B each exemplify a limited-life component that degrades owing to the rotation of the photoconductor drum 31. Here, the image forming unit 120 exemplifies the drive unit in the disclosure.

The image forming unit 120 also includes a charging device, an exposure device, and a developing device. The charging device electrically charges, by discharge, the photoconductor drum 31 uniformly, to a predetermined polarity. The exposure device irradiates the surface of the charged photoconductor drum 31 with a laser beam, thereby forming an electrostatic latent image. The developing device develops the electrostatic latent image by supplying the toner to the surface of the photoconductor drum 31, thereby forming a toner image.

The image forming device 12 further includes an intermediate transfer belt 122 and a secondary transfer roller 124. The intermediate transfer belt 122 is an endless belt stretched around primary transfer rollers 123B, 123Y, 123C, and 123M, a drive roller 35, and a follower roller 36. The intermediate transfer belt 122 is made to circulate counterclockwise, by the rotation of the drive roller 35. The follower roller 36 is made to rotate by the circulation of the intermediate transfer belt 122.

The image forming units 120B, 120Y, 120C, and 120M are located along the lower face of the intermediate transfer belt 122, and opposed thereto. In this embodiment, the image forming units 120B, 120Y, 120C, and 120M are aligned in this order from the upstream side to the downstream side, in the circulating direction of the lower face of the intermediate transfer belt 122.

Referring to FIG. 1, a direction toward one end of the direction in which the image forming units 120B, 120Y, 120C, and 120M are aligned (in this case, the direction toward the image forming unit 120M) will hereinafter be defined as first direction X1, and a direction toward the other end, in other words the direction opposite to the first direction X1 (the direction toward the image forming unit 120B), will hereinafter be defined as second direction X2.

The image forming units 120B, 120Y, 120C, and 120M each form a colored toner image using the toner supplied from the developing device of the corresponding color, on the basis of the image data generated by the image reading device 11, and transfer the colored toner image formed as above onto the surface of the intermediate transfer belt 122, via the corresponding one of the primary transfer rollers 123B, 123Y, 123C, and 123M, such that the toner images are stacked on each other. The secondary transfer roller 124 defines a transfer nip, with the drive roller 35. The secondary transfer roller 124 transfers the colored toner image formed on the surface of the intermediate transfer belt 122 onto the recording sheet P, when the recording sheet P being transported by the transport device 17 along a transport route T passes the transfer nip.

The fixing device 13 includes a fixing roller and a pressure roller. The fixing device 13 heats and presses the recording sheet P on which the toner image has been formed by the image forming device 12, to thereby fix the toner image onto the recording sheet. The recording sheet P on which the toner image has been fixed by the fixing device 13 is delivered by the transport device 17 to an output tray 8.

The paper feeding device 14 includes a manual bypass tray, and a plurality of paper cassettes. The paper feeding device 14 draws out the recording sheets P stored in one of the plurality of paper cassettes, or the recording sheets placed on the manual bypass tray, one by one with a pickup roller, and delivers the recording sheet to the transport route T.

The display device 15 is, for example, constituted of an LCD or an organic light-emitting diode (OLED) display. The display device 15 displays, under the control of the controller 10, various types of screen related to the functions that the image forming apparatus 1 is configured to perform, in the display region.

The operation device 16 includes a plurality of hard keys, such as a start key 16A for instructing the start of a desired function. The operation device 16 also includes a touch panel 16B overlaid on the display device 15. The user can input, through the operation device 16, various types of information, including instructions related to the functions that the image forming apparatus 1 is configured to perform.

The transport device 17 includes a transport roller pair 17A, a delivery roller pair 17B, and a transport motor connected to the transport roller pair 17A and the delivery roller pair 17B. The controller 10 drives the transport motor so as to rotate the transport roller pair 17A and the delivery roller pair 17B, thereby transporting the recording sheet P delivered from the paper feeding device 14 along the transport route T, toward the image forming device 12 and then to the output tray 8.

Figure 4:
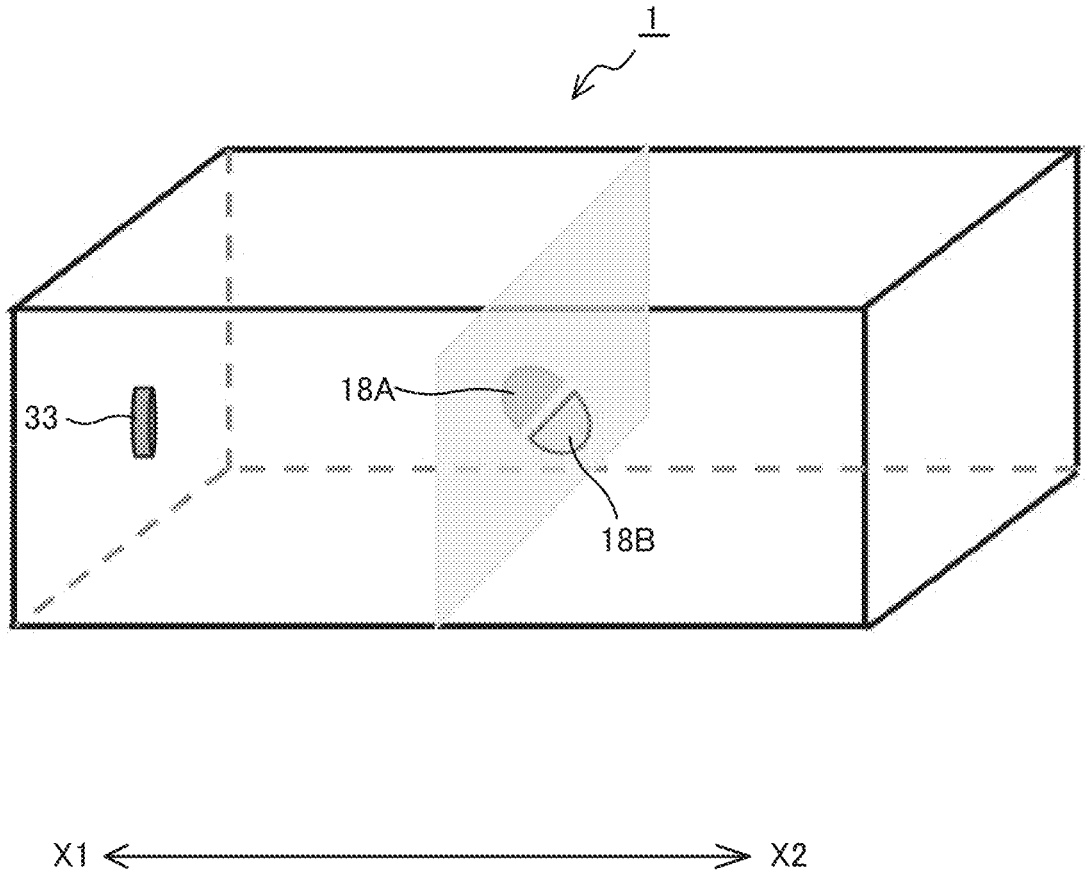
FIG. 4 is a schematic perspective view showing an example of a location of a sound collecting device.

FIG. 4 illustrates an example of the location of the sound collecting devices 18A and 18B. Referring to FIG. 4, the sound collecting devices 18A and 18B are located at a central position, inside the casing of the image forming apparatus 1. The sound collecting devices 18A and 18B each include a microphone to which the sound is inputted, and an A/D conversion circuit that converts an analog signal based on the sound inputted to the microphone, into a digital signal.

The sound collecting devices 18A and 18B each collect, under the control of the controller 10, the sound of the bearing 33, the first gear 34A, and the second gear 34B, emitted while the photoconductor drum 31 is rotating, and output sound data. Although the type of the microphone provided in each of the sound collecting devices 18A and 18B is not specifically limited, a monodirectional, cardioid type microphone is employed in this embodiment. The sound collecting device 18A collects the sound from the first direction X1, and outputs first sound data. The sound collecting device 18B collects the sound from the second direction X2, and outputs second sound data.

The image processing device 19 executes, as necessary, the image processing to the image data generated by the image reading device 11. The image memory 20 includes a region for temporarily storing the image data generated by the image reading device 11. The facsimile communication device 21 makes connection to the public telephone line, and transmits and receives the image data via the public telephone line.

The HDD 22 is a large-capacity storage device for storing various types of data, such as the image data generated by the image reading device 11. The HDD 22 contains control programs for realizing the functions of the image forming apparatus 1. As an example of the various programs, the HDD 22 contains a prediction program for executing a remaining service life prediction process according to the embodiment of the disclosure. Here, the HDD 22 exemplifies the storage device in the disclosure.

Figure 5:
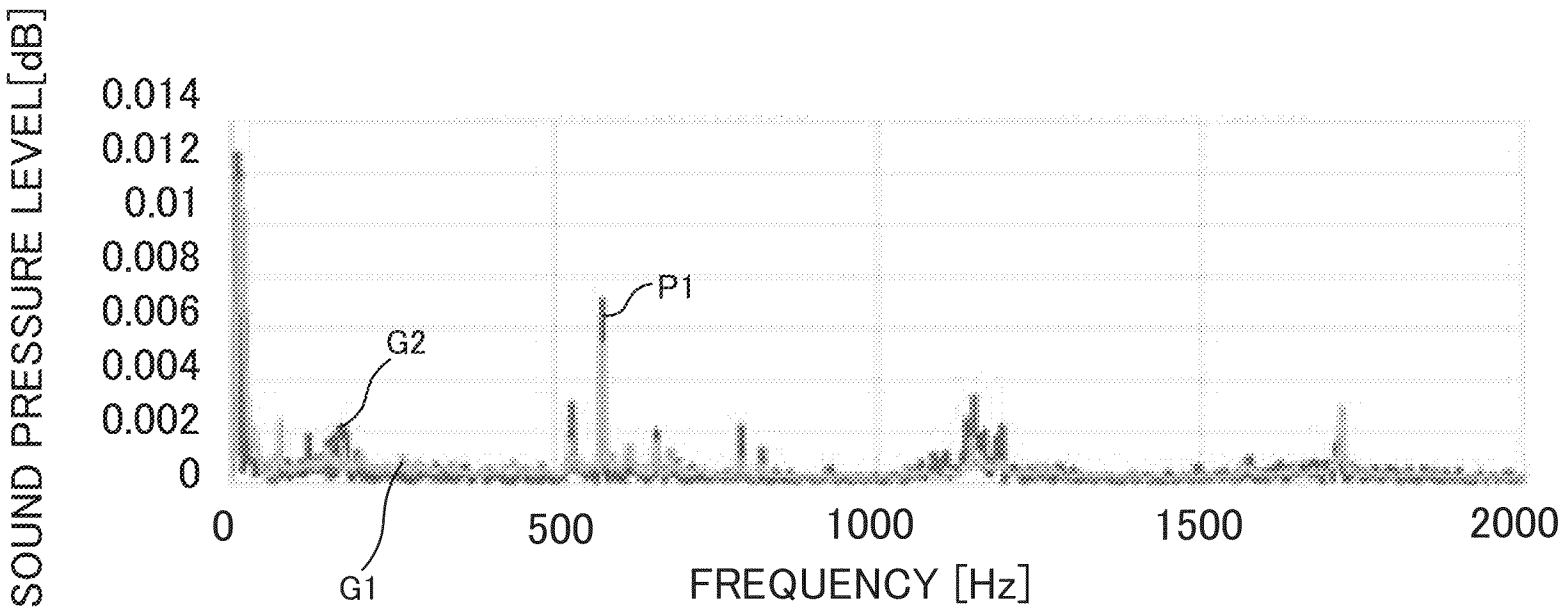
FIG. 5 is a graph showing a relation between resonance frequencies and sound pressure levels of a bearing, before and after endurance.

In the HDD 22, a specific frequency corresponding to each of the bearing 33, the first gear 34A, and the second gear 34B, is stored in advance. Referring to FIG. 5, the specific frequency of the bearing 33 will be described hereunder, as an example of the specific frequency. FIG. 5 is a graph showing results of the frequency analysis of the sound data representing the sound of the bearing 33, generated while the photoconductor drum 31 is rotating, the horizontal axis representing resonance frequency (Hz), and the vertical axis representing the sound pressure level (dB).

In FIG. 5, a light-colored graph G1 represents the state of the bearing 33 at an initial stage (i.e., before endurance). A dark-colored graph G2 represents the state of the bearing 33 after the photoconductor drum 31 has rotated a predetermined number of times (e.g., 500,000 times), in other words after the endurance. In the graph G1 and the graph G2, the peak values of the resonance frequency are the same, but the sound pressure levels are different.

To be more detailed, the bearing 33 has a specific resonance frequency, and the sound pressure level becomes higher with an increase in number of times of rotation of the photoconductor drum 31. In the HDD 22, the value of the resonance frequency corresponding to one of the plurality of peaks appearing in the graph G1 and the graph G2 (in this case, a characteristic peak P1), is stored as the specific frequency corresponding to the bearing 33.

In the HDD 22, the sound pressure levels corresponding to the specific frequency of each of the bearing 33, first gear 34A, and the second gear 34B are also stored in advance, with respect to each of different lengths of the remaining service life. The sound pressure level corresponding to each length of the remaining service life is determined through experiments, on the basis of sound data obtained by synthesizing the first sound data outputted from the sound collecting device 18A and the second sound data outputted from the sound collecting device 18B.

For example, with respect to the specific frequency of the bearing 33, the sound pressure levels, corresponding to the number of times of rotation of the photoconductor drum 31 in an increment of 100,000 times, are stored in the HDD 22, as the sound pressure level corresponding to each length of the remaining service life. In this embodiment, it will be assumed that the bearing 33 fails, when the number of times of rotation of the photoconductor drum 31 reaches a million times.

The communication device 23 includes a communication module such as a local area network (LAN) board. The controller 10 performs data communication with an external device such as the PC 24 connected via a network, through the communication device 23.

A power source is provided for each of the components of the image forming apparatus 1, so that those components are activated with the power supplied from the power source.

In this embodiment, controller 10 executes, by operating according to the prediction program, the remaining service life prediction process, including performing frequency analysis of the first and second sound data respectively outputted from the sound collecting devices 18A and 18B, acquiring the sound pressure level corresponding to the specific frequency of the limited-life component, on the basis of the result of the frequency analysis, comparing between the acquired sound pressure level and the sound pressure level corresponding to each of the different lengths of the remaining service life, predicting the remaining service life of the limited-life component, on the basis of the comparison result, and causing the display device 15 to display a notification screen showing the predicted remaining service life.

[Operation]

Figure 6:
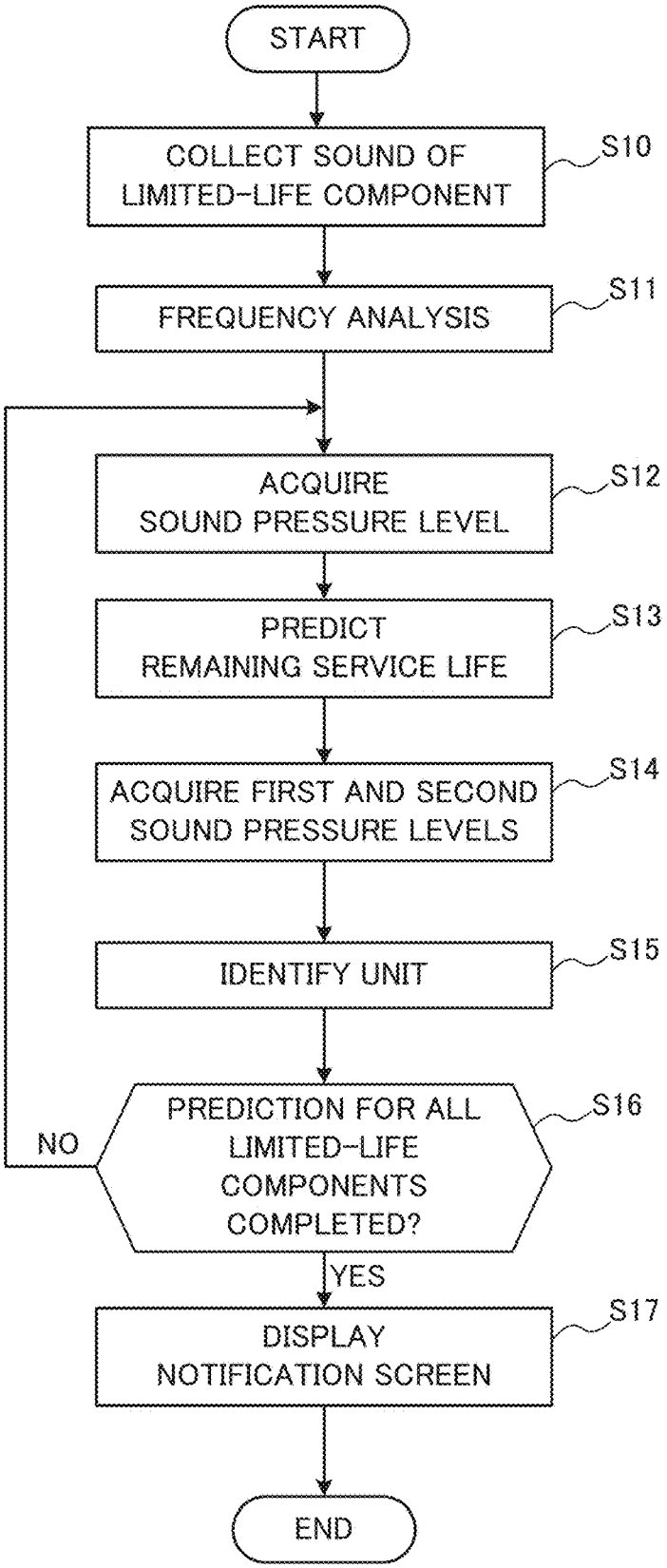
FIG. 6 is a flowchart showing a remaining service life prediction process.
Figure 7:
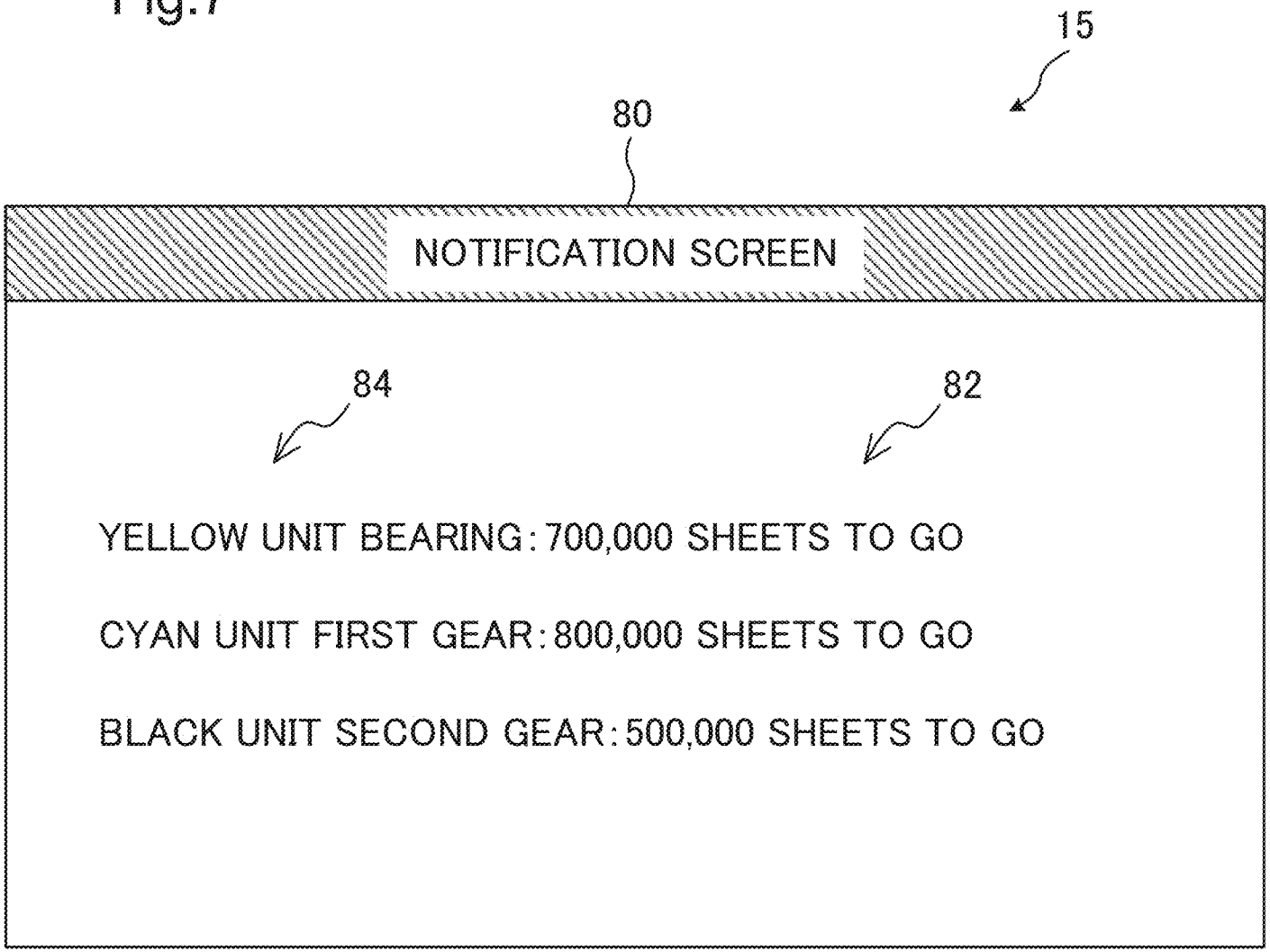
FIG. 7 is a schematic drawing showing an example of a notification screen.

FIG. 6 is a flowchart showing the remaining service life prediction process. FIG. 7 illustrates an example of the notification screen. Referring to FIG. 6 and FIG. 7, the operation of the image forming apparatus 1, performed when executing the remaining service life prediction process, will be described hereunder. In the following description, it will be assumed that the power supply to the image forming apparatus 1 is on.

When the user places a source document on the platen glass 7 of the image reading device 11, and presses the start key 16A to input the instruction to start a copying job, the controller 10 causes the image reading device 11, upon detecting that the start key 16A has been pressed, to read the source document and generate the image data. The controller 10 then causes the image forming device 12 to execute the image forming operation, including forming the source image represented by the image data generated as above, on the recording sheet P.

When the image forming operation is started, the controller 10 starts to execute the remaining service life prediction process shown in FIG. 6, and causes the sound collecting devices 18A and 18B to collect the sound of the bearing 33, the first gear 34A, and the second gear 34B, emitted while the photoconductor drum 31 is rotating during the image forming operation (step S10).

After step S10, the controller 10 synthesizes the first sound data outputted from the sound collecting device 18A and representing the sound from the first direction X1, and the second sound data outputted from the sound collecting device 18B and representing the sound from the second direction X2, and performs the frequency analysis of the synthesized sound data (step S11).

After step S11, the controller 10 selects one of the three specific frequencies stored in the HDD 22, and acquires the sound pressure level corresponding to the selected specific frequency, on the basis of the result of the frequency analysis (step S12). In this case, the specific frequency of the bearing 33.

Since the bearings 33 respectively provided in the image forming units 120B, 120Y, 120C, and 120M have the same specific frequency, the controller 10 acquires the highest sound pressure level, out of the sound pressure levels of the respective bearings 33, at step S12.

After step S12, the controller 10 compares between the sound pressure level acquired as above, and the sound pressure level corresponding to each length of the remaining service life, stored in the HDD 22 in association with the selected specific frequency, and predicts, on the basis of the comparison result, the remaining service life of the limited-life component corresponding to the selected specific frequency (step S13). For example, when the sound pressure level acquired with respect to the bearing 33 is closest to the sound pressure level corresponding to 300,000 times of rotation of the photoconductor drum 31, the controller 10 predicts 700,000 times of rotation, as the remaining service life of the bearing 33.

After step S13, the controller 10 performs the frequency analysis of each of the first sound data and the second sound data, and acquires, on the basis of the result of the frequency analysis, the first sound pressure level corresponding to the specific frequency selected with respect to the first sound data, and the second sound pressure level corresponding to the specific frequency selected with respect to the second sound data (step S14). In this case, the controller 10 acquires the first sound pressure level and the second sound pressure level, corresponding to the specific frequency of the bearing 33.

After step S14, the controller 10 identifies the image forming unit 120 that includes the limited-life component, the remaining service life of which has been predicted, out of the image forming units 120B, 120Y, 120C, and 120M, on the basis of a difference between the first sound pressure level and the second sound pressure level (step S15). For example, when the difference obtained by subtracting the second sound pressure level from the first sound pressure level is a positive value, and the absolute value of the difference is larger than a predetermined threshold, the controller 10 identifies the image forming unit 120M. When the difference obtained as above is a positive value, and the absolute value of the difference is equal to or smaller than the threshold, the controller 10 identifies the image forming unit 120C.

When the difference obtained as above is a negative value, and the absolute value of the difference is larger than the threshold, the controller 10 identifies the image forming unit 120B. When the difference obtained as above is a negative value, and the absolute value of the difference is equal to or smaller than the threshold, the controller 10 identifies the image forming unit 120Y.

After step S15, the controller 10 decides whether the prediction of the remaining service life has been completed, with respect to the limited-life components corresponding to all of the specific frequencies stored in the HDD 22 (step S16). In this case, since the prediction of the remaining service life of only the bearing 33 has been completed, the controller 10 decides that the prediction of the remaining service life has not been completed with respect to all of the limited-life components (NO at step S16), and returns to step S12.

Likewise, the controller 10 executes the operation of step S12 to step S16, with respect to each of the two remaining specific frequencies stored in the HDD 22. Upon deciding that the prediction of the remaining service life has been completed with respect to all of the limited-life components, namely the bearing 33, the first gear 34A, and the second gear 34B (YES at step S16), the controller 10 causes the display device 15 to display a notification screen 80, showing the remaining service life predicted with respect to the limited-life components, and the image forming unit 120 identified (step S17).

It is assumed here, for example, that at step S15 the image forming unit 120Y including the bearing 33, the remaining service life of which has been predicted as 700,000 times, has been identified, the image forming unit 120C including the first gear 34A, the remaining service life of which has been predicted as 800,000 times, has been identified, and the image forming unit 120B including the second gear 34B, the remaining service life of which has been predicted as 500,000 times, has been identified.

In this case, the controller 10 causes the display device 15 to display the notification screen 80 showing, as shown in FIG. 7, information 84 indicating the image forming unit and the limited-life component, the remaining service life of which has been predicted, and information 82 indicating the predicted remaining service life. After step S17, the controller 10 finishes the remaining service life prediction process.

Now, in the drive unit including the drive roller, the driving motor, and the limited-life components such as the bearing and the gear, the limited-life components are gradually worn and degraded, with the rotation of the drive roller. When the degree of degradation of the limited-life component reaches a certain level, the drive unit malfunctions. When the user starts to prepare for the replacement of the limited-life component, after the malfunction is reported, the downtime before the restoration may be prolonged, because it often takes time to procure the necessary components.

The aforementioned first to third techniques are not designed to predict the degradation status of the limited-life components such as the bearing and the gear, and are therefore unable to solve the mentioned drawback.

According to the foregoing embodiment, in contrast, the controller 10 performs the frequency analysis of the first and second sound data respectively outputted from the sound collecting devices 18A and 18B, acquires the sound pressure level corresponding to the specific frequency of the limited-life component, on the basis of the result of the frequency analysis, compares between the acquired sound pressure level and the sound pressure level corresponding to each of the different lengths of the remaining service life, predicts the remaining service life of the limited-life component, on the basis of the comparison result, and causes the display device 15 to display the information 82 on the notification screen 80.

In other words, the controller 10 predicts and notifies the remaining service life of the limited-life components, namely the bearing 33, the first gear 34A, and the second gear 34B, each time the image forming operation is executed. Therefore, the user can secure the period for the preparation for the replacement of the limited-life components. As result, the downtime, from the time that the malfunction of the limited-life component has occurred to the restoration thereof, can be shortened, compared with the case where the malfunction is reported at the time that the malfunction has occurred.

According to the foregoing embodiment, in addition, the controller 10 performs the frequency analysis of each of the first and second sound data, acquires the first sound pressure level and the second sound pressure level on the basis of the result of the frequency analysis, identifies the image forming unit 120 that includes the limited-life component, the remaining service life of which has been predicted, out of the image forming units 120B, 120Y, 120C, and 120M, on the basis of the difference between the first sound pressure level and the second sound pressure level, and causes the display device 15 to display the information 84 on the notification screen 80.

As above, the controller 10 identifies and notifies the image forming unit 120 that includes the limited-life component, the remaining service life of which has been predicted. Therefore, the user can promptly and easily replace the limited-life component.

According to the foregoing embodiment, further, the prediction of the remaining service life of the limited-life components by the controller 10 includes the prediction of the remaining service life of the bearing 33, the first gear 34A, and the second gear 34B. Such an arrangement further facilitates the user to promptly restore the image forming unit 120.

[Other Variations]

Although the controller 10 is configured to predict the remaining service life of the bearing 33, the first gear 34A, and the second gear 34B in the foregoing embodiment, the disclosure is not limited to such arrangement. The controller 10 may predict the remaining service life of at least one of the bearing 33, the first gear 34A, and the second gear 34B. For example, the controller 10 may predict only the remaining service life of the bearing 33.

According to the foregoing embodiment, the controller 10 executes the remaining service life prediction process, each time the image forming operation is executed. However, the disclosure is not limited to such embodiment. It suffices that the controller 10 executes the remaining service life prediction process at predetermined time points, for example every three days or once a week.

According to the foregoing embodiment, the image forming apparatus 1 includes a pair of sound collecting devices 18A and 18B located at the central position inside the casing. However, the disclosure is not limited to such embodiment. The number of the sound collecting devices 18 and the location thereof may be determined in consideration of the directionality of the microphone. For example, the image forming apparatus 1 may include a single sound collecting device having a bidirectional microphone for the direction X1 and the second direction X2, at the central position inside the casing.

Further, although the controller 10 causes the display device 15 to display the information 82 and the information 84 on the notification screen 80, in the foregoing embodiment, the disclosure is not limited to such embodiment. For example, the controller 10 may cause the display device 15 to display only the information 82, on the notification screen 80.

The drive unit is not limited to the image forming unit 120. The drive unit may be a different unit, provided that the unit includes a drive roller, a driving motor, and a limited-life component. For example, the drive unit may be the transport device 17, or the paper feeding device 14.

Further, although the image forming device 12 is configured to form an image on the recording sheet P in the embodiment, the disclosure is not limited to such embodiment. The image forming device 12 may form an image on a different type of recording medium, without limitation to the recording sheet. For example, an overhead projector (OHP) sheet may be used instead.

The disclosure may be modified in various manners, without limitation to the configuration according to the foregoing embodiment. For example, although the electronic apparatus is exemplified by the image forming apparatus 1 configured as a color multifunction peripheral in the embodiment, a different type of image forming apparatus, such as a monochrome multifunction peripheral, a copier, or a facsimile machine, may be employed.

The configurations and processings according to the foregoing embodiments, described with reference to FIG. 1 to FIG. 7, are merely exemplary and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. An electronic apparatus comprising:

a drive unit including a drive roller configured to rotate about an axial line, a driving motor connected to the drive roller, and a limited-life component that degrades with rotation of the drive roller;

a control device including a processor, and configured to act as a controller that drives the driving motor so as to rotate the drive roller, when the processor executes a control program;

a sound collecting device that collects sound of the limited-life component generated while the drive roller is rotating, and outputs sound data;

a storage device storing in advance a sound pressure level corresponding to a specific frequency of a limited-life component, with respect to each of different lengths of the remaining service life; and a display device, the controller being configured to:

perform frequency analysis of the sound data outputted from the sound collecting device at each of predetermined time points;

acquire the sound pressure level corresponding to the specific frequency of the limited-life component, on a basis of a result of the frequency analysis;

compare between the acquired sound pressure level and the sound pressure level corresponding to each of the different lengths of the remaining service life;

predict the remaining service life of the limited-life component, on a basis of a comparison result; and cause the display device to display a screen showing the predicted remaining service life, wherein the electronic apparatus includes a plurality of the drive units respectively located at different positions, the sound collecting device collects the sound from a predetermined first direction, and a second direction opposite to the first direction, and the controller is configured to:

perform the frequency analysis of each of first sound data representing the sound from the first direction and second sound data representing the sound from the second direction;

acquire a first sound pressure level corresponding to the specific frequency of the limited-life component with respect to the first sound data, and a second sound pressure level corresponding to the specific frequency of the limited-life component with respect to the second sound data, on a basis of a result of the frequency analysis; and identify the drive unit that includes the limited-life component, the remaining service life of which has been predicted, out of the plurality of the drive units, on a basis of a difference between the first sound pressure level and the second sound pressure level.

2. The electronic apparatus according to claim 1, further comprising:

a bearing rotatably supporting the drive roller; and a gear that transmits driving force of the driving motor to the drive roller, wherein the controller predicts at least one of the remaining service life of the bearing and the remaining service life of the gear, as the remaining service life of the limited-life component.

3. The electronic apparatus according to claim 1, wherein the controller identifies the drive unit that includes the limited-life component, the remaining service life of which has been predicted, out of a plurality of the drive units, depending on whether a difference between the first sound pressure level and the second sound pressure level is a positive value or a negative value, and whether an absolute value of the difference is larger than a predetermined threshold.

* * * * *